US010164309B2

(12) United States Patent
Pu et al.

(10) Patent No.: US 10,164,309 B2
(45) Date of Patent: Dec. 25, 2018

(54) DIELECTRIC RESONATOR AND DIELECTRIC FILTER

(71) Applicant: Huawei Technologies Co., Ltd., Shenzhen (CN)

(72) Inventors: Guosheng Pu, Yokohama (JP); Yanlin Song, Shanghai (CN); Zhen Shen, Shanghai (CN); Jing Shi, Yokohama (JP)

(73) Assignee: Huawei Technologies Co., Ltd, Shenzhen (CN)

( * ) Notice: Subject to any disclaimer, the term of this patent is extended or adjusted under 35 U.S.C. 154(b) by 110 days.

(21) Appl. No.: 15/153,560

(22) Filed: May 12, 2016

(65) Prior Publication Data

US 2016/0261016 A1 Sep. 8, 2016

Related U.S. Application Data

(63) Continuation of application No. PCT/CN2013/086918, filed on Nov. 12, 2013.

(51) Int. Cl.

*H01P 1/208* (2006.01)
*H01P 7/10* (2006.01)
*H01P 1/20* (2006.01)

(52) U.S. Cl.

CPC ..... *H01P 1/2086* (2013.01); *H01P 1/2002* (2013.01); *H01P 1/2084* (2013.01); *H01P 7/10* (2013.01); *H01P 7/105* (2013.01)

(58) Field of Classification Search

CPC ..... H01P 1/2088; H01P 7/10; H01P 7/105; H01P 3/122; H01P 3/16; H01P 1/2086

(Continued)

(56) References Cited

U.S. PATENT DOCUMENTS 4,453,146 A 6/1984 Fiedziuszko
5,675,301 A 10/1997 Näppä et al.

(Continued)

FOREIGN PATENT DOCUMENTS

CN 1269913 A 10/2000
CN 201725857 U 1/2011

(Continued)

OTHER PUBLICATIONS

Park, J.-C. et al., "A Novel Dielectric Resonator Perturbation Configuration for the Dual Mode Bandpass Filters," IEEE 1999 Asia Pacific Microwave Conference, Singapore, Nov. 30-Dec. 3, 1999, pp. 856-859.

*Primary Examiner* — Rakesh B Patel
(74) *Attorney, Agent, or Firm* — Slater Matsil, LLP

(57) ABSTRACT

The present application provides a dielectric filter, including a body part, a dielectric resonator, a cavity is formed in the body part, and a support kit is disposed at a bottom of the cavity. The dielectric resonator, including a dielectric body and at least two adjusting holes disposed on the dielectric body, is contained in the cavity and is disposed on the support kit. The dielectric body has a first mirror plane and a second mirror plane, which are perpendicular to each other and penetrate through the top plane and the bottom plane of the dielectric body, and any two of the at least two adjusting holes are not mirror symmetric relative to the first mirror plane or the second mirror plane.

20 Claims, 7 Drawing Sheets

(58) Field of Classification Search
USPC ..... 333/208, 209, 219.1
See application file for complete search history.

(56) References Cited

U.S. PATENT DOCUMENTS

| | | | | |
|---|---|---|---|---|
| 5,764,115 | A | 6/1998 | Hattori et al. | |
| 5,783,979 | A * | 7/1998 | Andoh | H01P 7/10 333/202 |
| 6,411,181 | B1 * | 6/2002 | Ishikawa | H01P 7/10 333/134 |
| 6,496,087 | B1 * | 12/2002 | Hattori | H01P 7/105 333/202 |
| 2001/0024147 | A1 | 9/2001 | Arakawa et al. | |
| 2003/0006864 | A1 | 1/2003 | Hattori et al. | |
| 2003/0117244 | A1 | 6/2003 | Matsuura et al. | |
| 2013/0249651 | A1 | 9/2013 | Wu et al. | |

FOREIGN PATENT DOCUMENTS

| | | | |
|---|---|---|---|
| CN | 102368574 | A | 3/2012 |
| CN | 103367846 | A | 10/2013 |
| JP | 07245509 | A | 9/1995 |
| JP | H11145704 | A | 5/1999 |
| KR | 20130063684 | A | 6/2013 |

* cited by examiner

DIELECTRIC RESONATOR AND DIELECTRIC FILTER

CROSS-REFERENCE TO RELATED APPLICATIONS

This application is a continuation of International Application No. PCT/CN2013/086918, filed on Nov. 12, 2013, which is hereby incorporated by reference in its entirety.

TECHNICAL FIELD

The present application relates to the field of communications technologies, and in particular, to a dielectric resonator and a dielectric filter.

BACKGROUND

Due to the development of radio communication technologies, a high-performance filter is required in a low-cost and high-performance wireless communications transceiver system. A dielectric filter is widely used in various communications systems because of its small size, low loss, and high selectivity. The dielectric filter includes a cavity, a dielectric resonator fastened inside the cavity, a cover, and an adjusting screw. The adjusting screw is used to adjust a frequency and bandwidth of the dielectric filter. A dual-mode dielectric filter is a type of dielectric filter. The dielectric filter is designed by using a dielectric material (such as ceramic) that is characterized by a low loss, a high dielectric constant, a small frequency temperature coefficient, a small coefficient of thermal expansion, and a capability of bearing high power, and the like. Generally, the dielectric filter may be formed by ladder-shaped lines with several cuboid resonators that are lengthwise connected in series or in parallel at different levels. The dielectric filter is characterized by a low insertion loss, a capability of bearing high power, and narrow bandwidth; the dielectric filter is especially suitable for filtering of 900 MHz, 1.8 GHz, 2.4 GHz, and 5.8 GHz frequencies; the dielectric filter may be applied to area coupled filtering of a portable phone, an automobile phone, a wireless headset, a wireless microphone, a radio station, a cordless telephone set, or an integrated transceiver duplexer. The dual-mode dielectric filter is a filter that uses a dual-mode dielectric resonator. One dual-mode dielectric resonator can simultaneously operate in two working modes, and one working mode corresponds to one resonance frequency; therefore, the dual-mode dielectric resonator can simultaneously operate at two resonance frequencies. The working mode refers to a pattern of an electric field or a magnetic field in which the resonator works. For the dielectric resonator, its working modes usually include a TM (Transverse Magnetic) mode, a TE (Transverse Electric) mode, or an HE (Hybrid Electromagnetic) mode (that may include two working modes of the HE, and is also referred to as an HE dual-mode). Generally, the dual-mode dielectric filter includes the HE dual-mode. In the dual-mode dielectric filter, the adjusting screw is disposed around the cavity of the dual-mode dielectric filter, which does not facilitate adjustment of the dual-mode dielectric filter and assembling of other components.

SUMMARY

A technical problem to be solved by embodiments of the present application is to provide a dielectric resonator and a dielectric filter, so as to facilitate adjustment and assembling.

A first aspect provides a dielectric resonator, which is configured to be disposed in a cavity of a dielectric filter and includes a dielectric body. At least two holes are disposed on the dielectric body and the dielectric body includes a top plane and a bottom plane. The at least two holes penetrate through the top plane and the bottom plane of the dielectric body. The dielectric body has a first mirror plane and a second mirror plane, and the second mirror plane is perpendicular to the first mirror plane. The at least two holes are not mirror symmetric relative to the first mirror plane and the second mirror plane.

In a first possible implementation manner of the first aspect, the dielectric body has a first diagonal plane and a second diagonal plane, and axes of the at least two holes are separately on the first diagonal plane and the second diagonal plane or are both on one diagonal plane of the first diagonal plane and the second diagonal plane.

With reference to the first possible implementation manner of the first aspect, in a second possible implementation manner, the at least two holes include a first hole and a second hole, and an axis of the first hole is on the first diagonal plane, an axis of the second hole is on the second diagonal plane, or the axes of the first hole and the second hole are both on the second diagonal plane.

With reference to the second possible implementation manner of the first aspect, in a third possible implementation manner, the at least two holes further include a third hole, and an axis of the third hole is on the second diagonal plane and is parallel with the axis of the second hole.

With reference to the third possible implementation manner of the first aspect, in a fourth possible implementation manner, the at least two holes further include a fourth hole, and an axis of the fourth hole is on the first diagonal plane and is parallel with the axis of the first hole.

With reference to the fourth possible implementation manner of the first aspect, in a fifth possible implementation manner, the first to the fourth holes are cylindrical holes, and a hole size of the first hole is the same as a hole size of the fourth hole, a hole size of the second hole is the same as a hole size of the third hole, and the hole size of the first hole is different from the hole size of the second hole.

With reference to the second possible implementation manner of the first aspect, in a sixth possible implementation manner, the at least two holes further include a fifth hole, and an axis of the fifth hole is an intersection line of the first diagonal plane and the second diagonal plane.

With reference to the second possible implementation manner of the first aspect, in a seventh possible implementation manner, the axis of the second hole is an intersection line of the first diagonal plane and the second diagonal plane.

With reference to the seventh possible implementation manner of the first aspect, in an eighth possible implementation manner, the second hole is connected to the first hole.

With reference to any one of the first possible implementation manner to the eighth possible implementation manner of the first aspect, in a ninth possible implementation manner, when the dielectric body is a cylinder, the first diagonal plane and the second diagonal plane are perpendicular to each other, and sector planes of two adjacent included angles formed between the first diagonal plane and the second diagonal plane are planes on which axes of a first port and a second port of the dielectric filter are separately located.

With reference to any one of the first possible implementation manner to the ninth possible implementation manner of the first aspect, in a tenth possible implementation manner, the first mirror plane is a plane on which an axis of the first port of the dielectric filter is located, and the second mirror plane is a plane on which an axis of the second port of the dielectric filter is located.

A second aspect provides a dielectric filter, including a body part, a cover, and a first dielectric resonator according to any one of the foregoing implementation manners. The body part includes a first port and a second port, and the first port and the second port are configured to input and output signals. A first cavity is further formed in the body part, and a first support kit is disposed at a bottom of the first cavity. The first dielectric resonator is contained in the first cavity and is disposed on the first support kit.

In a first possible implementation manner of the second aspect, an axis of the first port is on the first mirror plane, and an axis of the second port is on the second mirror plane.

In a second possible implementation manner of the second aspect, or with reference to the first possible implementation manner of the second aspect, in a second possible implementation manner, screws are arranged in positions that are on the cover and correspond to the first adjusting hole and the second adjusting hole, so as to adjust at least one of a frequency and bandwidth of the dielectric filter.

In a third possible implementation manner of the second aspect, or with reference to the first possible implementation manner or the second possible implementation manner of the second aspect, in a third possible implementation manner, the dielectric filter further includes a second dielectric resonator and a coupled mechanical part; a second cavity is further formed in the dielectric filter, and a second support kit is disposed at a bottom of the second cavity; the second dielectric resonator is contained in the second cavity and is disposed on the second support kit; and the second dielectric resonator is connected to the first dielectric resonator by using the coupled mechanical part.

A third aspect provides a dielectric filter, including a body part, a cover and a dielectric resonator, where the body part includes a first port and a second port, and the first port and the second port are configured to input and output signals. A first cavity is further formed in the body part, and a first support kit is disposed at a bottom of the first cavity. The first dielectric resonator is contained in the first cavity and is disposed on the first support kit. The dielectric resonator includes a dielectric body, where at least two holes are disposed on the dielectric body and the dielectric body includes a top plane and a bottom plane, where the at least two holes penetrate through the top plane and the bottom plane of the dielectric body. Screws are arranged on the cover, and the screws are configured to adjust at least one of a frequency and bandwidth of the dielectric filter.

In a first possible implementation manner of the third aspect, the screws are arranged in positions that are on the over and correspond to the at least two adjusting holes.

In the present application, the at least two holes are not mirror symmetric relative to the first mirror plane and the second mirror plane, thereby changing a dielectric structure of the dielectric body of the dielectric resonator. Theoretically, according to principles of an electromagnetic field, a change of the dielectric structure of the dielectric body of the dielectric resonator may lead to a change in distribution of the electromagnetic field inside the dielectric resonator and the dielectric filter. According to simulation results, the change in the distribution of the electromagnetic field inside the dielectric resonator may change the frequency and the bandwidth of the dielectric resonator, that is, the frequency and the bandwidth of the dielectric filter may be adjusted; therefore, a purpose of changing the frequency and the bandwidth of the dielectric filter is achieved.

BRIEF DESCRIPTION OF THE DRAWINGS

To describe the technical solutions in the embodiments of the present application more clearly, the following briefly introduces the accompanying drawings required for describing the embodiments. Apparently, the accompanying drawings in the following description show merely some embodiments of the present application, and a person of ordinary skill in the art may still derive other drawings from these accompanying drawings without creative efforts.

DETAILED DESCRIPTION OF ILLUSTRATIVE EMBODIMENTS

The following clearly describes the technical solutions in the embodiments of the present application with reference to the accompanying drawings in the embodiments of the present application. Apparently, the described embodiments are merely a part rather than all of the embodiments of the present application. All other embodiments obtained by a person of ordinary skill in the art based on the embodiments of the present application without creative efforts shall fall within the protection scope of the present application.

Figure 1:
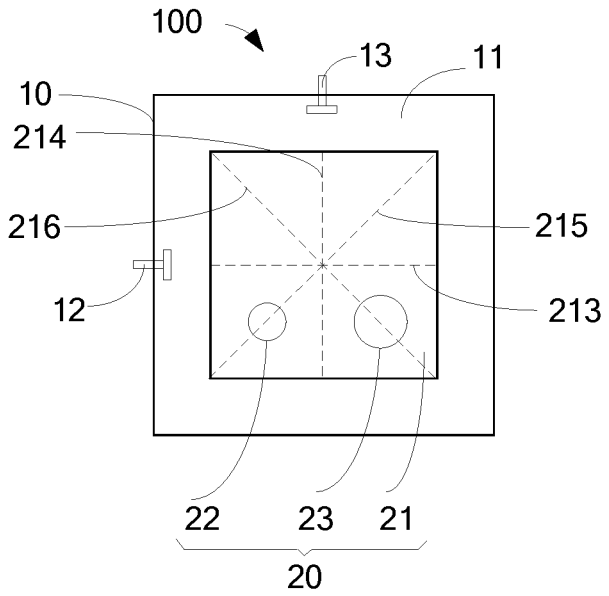
FIG. 1 is a schematic top view of a dielectric filter according to a first exemplary embodiment of the present application.
Figure 2:
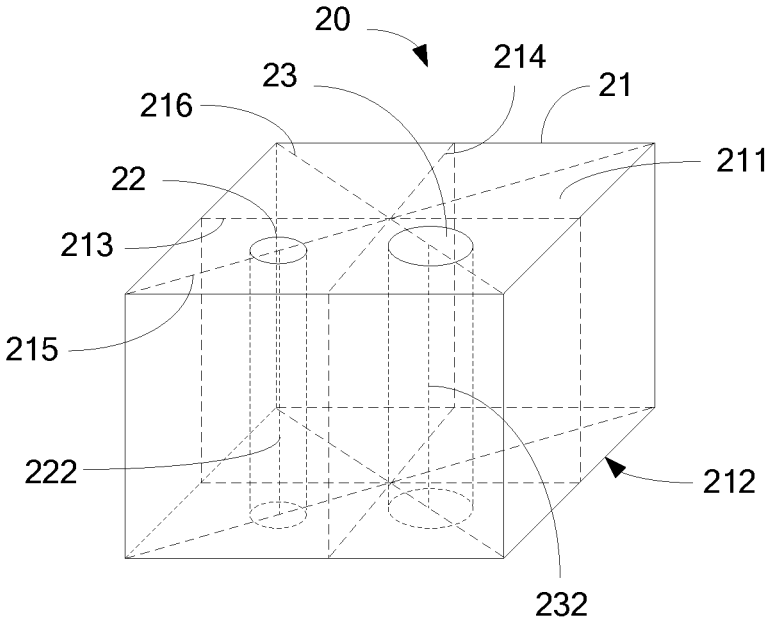
FIG. 2 is a schematic diagram of a first exemplary embodiment of the dielectric resonator in FIG. 1.
Figure 3:
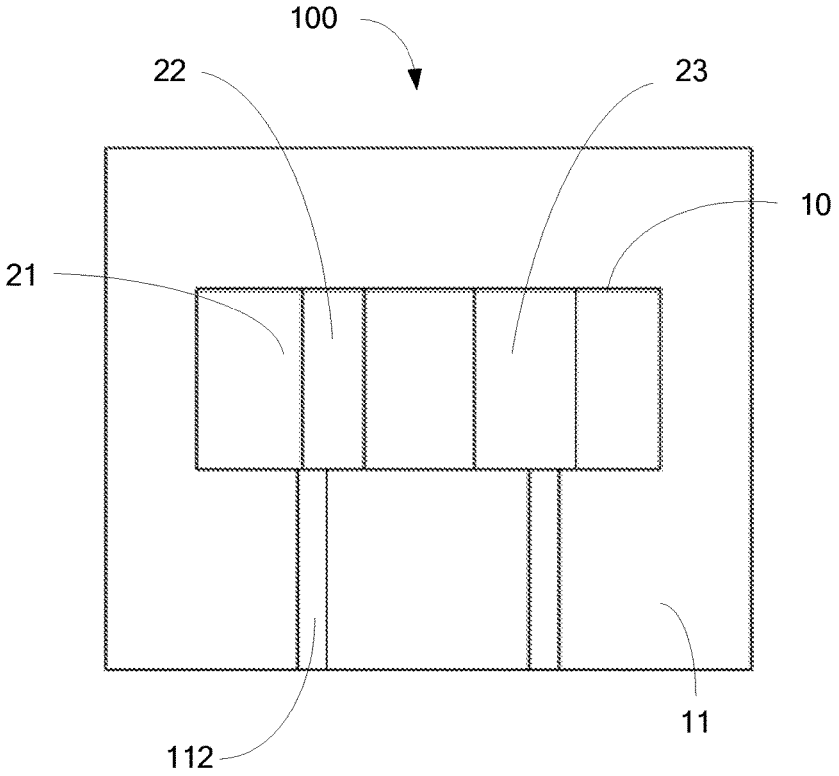
FIG. 3 is a side view of the dielectric filter in FIG. 1.

Reference is made to FIG. 1 to FIG. 3, and a first embodiment of the present application provides a dielectric filter 100. The dielectric filter 100 includes a body part 10, a cover (not shown), and a first dielectric resonator 20. The body part 10 includes a first port 12 and a second port 13. The first port 12 and the second port 13 are used to input and output signals. A first cavity 11 is further formed in the body part 10. A first support kit 112 is disposed at a bottom of the first cavity 11. The first dielectric resonator 20 is contained in the first cavity 11 and is disposed on the first support kit 112. Generally, a material of the body part 100 and the cover may be a metallic material, or a material plated with metal.

The first dielectric resonator 20 includes a dielectric body 21, and the dielectric body 21 has at least two holes. The two holes may be referred to as adjusting holes. Because the holes that are disposed on the dielectric body 21 may change distribution of an electromagnetic field inside the dielectric body 21 when same signals exist, the holes are referred to as adjusting holes. The dielectric body 21 includes a top plane 211 and a bottom plane 212. The at least two adjusting holes penetrate through the top plane 211 and the bottom plane 212 of the dielectric body 21. The cover corresponds to the top plane 211 of the dielectric body 21. The dielectric body 21 has a first mirror plane 213 and a second mirror plane 214. The first mirror plane 213 and the second mirror plane 214 are perpendicular to each other and penetrate through the top plane 211 and the bottom plane 212 of the dielectric body 21. The at least two adjusting holes are not mirror symmetric relative to the first mirror plane 213 or the second mirror plane 214. Mirror symmetry is usually used to describe a relationship between two objects. Herein, any two of the at least two adjusting holes are not mirror symmetric relative to the first mirror plane 213 or the second mirror plane 214.

A material of the dielectric body 21 may be a material that is characterized by a high dielectric constant, a low loss, a stable temperature coefficient, and the like, such as ceramic and titanate.

It may be understood that, the foregoing at least two adjusting holes disposed on the dielectric body 21 do not refer to all adjusting holes disposed on the dielectric body 21. The at least two adjusting holes disposed on the dielectric body 21 may be at least two adjusting holes among all the adjusting holes disposed on the dielectric body, for example two, three, or four adjusting holes; certainly, the at least two adjusting holes disposed on the dielectric body 21 may also be all the adjusting holes, which may be designed according to actual settings of a frequency and bandwidth of the dielectric resonator.

An improvement of all the embodiments of the present application lies in the first dielectric resonator 20. Therefore, the present application does not set any limitation to structures of other parts (such as the body part 10 and the cover) of the dielectric filter 100.

In this implementation manner, the dielectric resonator 20 may be a dual-mode dielectric resonator. That is, the dielectric resonator 20 may have two working frequencies (that is, resonance frequencies). The dielectric filter 100 may be referred to as a multihole dual-mode dielectric filter.

A central line of the first port 12 may be on the first mirror plane 213. A central line of the first port 13 may be on the second mirror plane 214.

Further, the dielectric body 21 has a first diagonal plane 215 and a second diagonal plane 216. Axes of the at least two adjusting holes may be separately on the first diagonal plane 215 and the second diagonal plane 216, or may be both on one diagonal plane of the first diagonal plane 215 and the second diagonal plane 216.

In this implementation manner, the at least two adjusting holes may include a first adjusting hole 22 and a second adjusting hole 23. The first adjusting hole 22 and the second adjusting hole 23 are perpendicular to each other and penetrate through the top plane 211 and the bottom plane 212 of the dielectric body 21. An axis 222 of the first adjusting hole 22 is on the first diagonal plane 215. An axis 232 of the second adjusting hole 23 is on the second diagonal plane 216.

Both the first adjusting hole 22 and the second adjusting hole 23 are in a cylindrical shape. The dielectric body 21 is a cube.

In other implementation manners, a shape of the first adjusting hole 22 or the second adjusting hole 23 may be another shape, such as a prismatic shape. The first adjusting hole 22 or the second adjusting hole 23 may also penetrate through the top plane 211 and the bottom plane 212 of the dielectric body 21 in other manners, such as in sideways, trapezoidal or S-shape manner, as long as the first adjusting hole 22 and the second adjusting hole 23 are not mirror symmetric relative to the first mirror plane 213 or the second mirror plane 214. The dielectric body 21 may be in other shapes, such as a circle or a hexagon. When the dielectric body 21 is a cylinder, the first diagonal plane 215 and the second diagonal plane 216 are perpendicular to each other.

When the first adjusting hole 22 and the second adjusting hole 23 are mirror symmetric relative to the first mirror plane 213 or the second mirror plane 214, a screw may be disposed on the cover. Herein, the screw may be referred to as an adjusting screw because the screw is a screw that is used to adjust the frequency or the bandwidth of the dielectric resonator. A material of the screw may be metallic or another dielectric material, which is not limited herein.

Specifically, a first adjusting screw may be arranged in a position that is on the cover and corresponds to the first adjusting hole 22. A second adjusting screw may be arranged in a position that is on the cover and corresponds to the second adjusting hole 23. Because the first adjusting hole 22 and the second adjusting hole 23 are mirror symmetric relative to the first mirror plane 213 or the second mirror plane 214, a hole size of the first adjusting hole 22 is equal to a hole size of the second adjusting hole 23, and variations of the two working frequencies of the dielectric resonator 20 are the same. Bandwidth of the dielectric resonator 20 is a difference of the two working frequencies of the dielectric resonator 20. Therefore, the bandwidth of the dielectric resonator 20 does not change. In this case, by means of adjustment of at least one of the first adjusting screw and the second adjusting screw to insert the first adjusting screw or the second adjusting screw into the first cavity 11, the bandwidth of the dielectric resonator 20 may be increased. The longer a part of at least one of the first adjusting screw and the second adjusting screw that is inserted into the first cavity 11, the greater the bandwidth of the dielectric resonator 20 is. On the contrary, by means of adjustment of at least one of the first adjusting screw and the second adjusting screw to pull out the first adjusting screw or the second adjusting screw from the first cavity 11, the bandwidth of the dielectric resonator 20 may be decreased. The shorter a part of at least one of the first adjusting screw and the second adjusting screw that is inside the first cavity 11, the less the bandwidth of the dielectric resonator 20 is.

It should be noted that the number of adjusting screws arranged on the cover may be adjusted according to an actual requirement. For example, only the first adjusting screw may be arranged in the position that is on the cover and corresponds to the first adjusting hole 22. By means of adjustment of the first adjusting screw to insert it into the first cavity 11, the bandwidth of the dielectric resonator 20 may be increased; or by means of pullout of the first adjusting screw from the first cavity 11, the bandwidth of the dielectric resonator 20 may be decreased.

Because arranging the first adjusting screw or the second adjusting screw in the position corresponding to the first adjusting hole or the second adjusting hole does not limit an adjustable length of the first adjusting screw or the second adjusting screw, an adjustment range of the bandwidth may be extended.

In this implementation manner, the dielectric filter 100 includes one dielectric resonator 20. Therefore, the frequency and the bandwidth of the dielectric resonator 20 are a frequency and bandwidth of the dielectric filter 100. Therefore, the bandwidth of the dielectric filter 100 does not change either. By means of adjustment of the adjusting screw to change distribution of an air medium in the first cavity in which the dielectric resonator 20 is located, distribution of at least one of an electric field and a magnetic field inside the dielectric resonator 20 and the dielectric filter 100 may further be changed, therefore the frequency and the bandwidth of the dielectric resonator 20 are changed, and further the frequency and the bandwidth of the dielectric filter 100 are changed. In other implementation manners, if the dielectric filter 100 includes multiple dielectric resonators, the frequency and the bandwidth of the dielectric filter 100 are in a specified relationship with frequencies and bandwidth of the multiple dielectric resonators. This specified relationship is well known in the art and is not described herein again. In short, the frequency and the bandwidth of the dielectric filter 100 change as the frequency and the bandwidth of the dielectric resonator inside the dielectric filter 100 change. For example, the dielectric filter 100 includes a first dielectric resonator, a second dielectric resonator, and a third dielectric resonator. The bandwidth of the dielectric filter and bandwidth of the first to the third dielectric resonators have the following relationship: the bandwidth of the dielectric filter is equal to 1.1 times coupling bandwidth between the first dielectric resonator and the second resonator, where the coupling bandwidth between the first dielectric resonator and the second dielectric resonator is equal to coupling bandwidth between the second dielectric resonator and the third dielectric resonator.

When the adjusting screw is inserted into the first cavity 11, the distribution of the air medium inside the first cavity in which the dielectric resonator 20 is located may be changed. In addition, as the adjusting screw moves inside the cavity 11, the distribution of the air medium inside the first cavity in which the dielectric resonator is located constantly changes, which enables the dielectric filter 100 to have different frequencies and bandwidth. Therefore, in this embodiment of the present application, an adjustment range of the dielectric filter 100 may be extended.

When the first adjusting hole 22 and the second adjusting hole 23 are not mirror symmetric relative to the first mirror plane and the second mirror plane, the adjusting screw may also be disposed on the cover. By means of adjustment of the adjusting screw to further change the distribution of the air medium inside the first cavity in which the dielectric resonator 20 is located, the distribution of the electromagnetic field inside the dielectric resonator 20 and the dielectric filter 100 may be further changed, therefore the frequency and the bandwidth of the dielectric filter 100 are further adjusted.

Specifically, the first adjusting screw may be arranged in the position that is on the cover and corresponds to the first adjusting hole 22. The second adjusting screw may be arranged in the position that is on the cover and corresponds to the second adjusting hole 23 When the hole size of the first adjusting hole 22 is greater than the hole size of the second adjusting hole 23, by means of adjustment of the first adjusting screw to insert the first adjusting screw into the first cavity 11, the bandwidth of the dielectric resonator 20 may be decreased, where the longer a part of the first adjusting screw that is inserted into the first cavity 11, the less the bandwidth of the dielectric resonator 20 is. On the contrary, by means of adjustment of the first adjusting screw to pull out the first adjusting screw from the first cavity 11, the bandwidth of the dielectric resonator 20 may be increased, where the shorter a part of the first adjusting screw that is inside the first cavity 11, the greater the bandwidth of the dielectric resonator 20 is. By means of adjustment of the second adjusting screw to insert the second adjusting screw into the first cavity 11, the bandwidth of the dielectric resonator 20 may be increased, where the longer a part of the second adjusting screw that is inserted into the first cavity 11, the greater the bandwidth of the dielectric resonator 20 is. On the contrary, by means of adjustment of the second adjusting screw to pull out the second adjusting screw from the first cavity 11, the bandwidth of the dielectric resonator 20 may be decreased, where the shorter a part of the second adjusting screw that is inside the first cavity 11, the less the bandwidth of the dielectric resonator 20 is.

When the hole size of the first adjusting hole 22 is less than the hole size of the second adjusting hole 23, by means of adjustment of the first adjusting screw to insert the first adjusting screw into the first cavity 11, the bandwidth of the dielectric resonator 20 may be increased, where the longer the part of the first adjusting screw that is inserted into the first cavity 11, the greater the bandwidth of the resonator 20 is. On the contrary, by means of adjustment of the first adjusting screw to pull out the first adjusting screw from the first cavity 11, the bandwidth of the dielectric resonator 20 may be decreased, where the shorter the part of the first adjusting screw that is inside the first cavity 11, the less the bandwidth of the dielectric resonator 20 is. By means of adjustment of the second adjusting screw to insert the second adjusting screw into the first cavity 11, the bandwidth of the dielectric resonator 20 may be decreased, where the longer the part of the second adjusting screw that is inserted into the first cavity 11, the less the bandwidth of the dielectric resonator 20 is. On the contrary, by means of adjustment of the second adjusting screw to pull out the second adjusting screw from the first cavity 11, the bandwidth of the dielectric resonator 20 may be increased, where the shorter the part of the second adjusting screw that is inside the first cavity 11, the greater the bandwidth of the dielectric resonator 20 is.

When the hole size of the first adjusting hole 22 is equal to the hole size of the second adjusting hole 23, by means of adjustment of at least one of the first adjusting screw and the second adjusting screw to insert the first adjusting screw or the second adjusting screw into the first cavity 11, the bandwidth of the dielectric resonator 20 may be increased, where the longer the part of at least one of the first adjusting screw and the second adjusting screw that is inserted into the first cavity 11, the greater the bandwidth of the dielectric resonator 20 is. On the contrary, by means of adjustment of at least one of the first adjusting screw and the second adjusting screw to pull out the first adjusting screw or the second adjusting screw from the first cavity 11, the bandwidth of the dielectric resonator 20 may be decreased, where the shorter the part of at least one of the first adjusting screw and the second adjusting screw that is inside the first cavity 11, the less the bandwidth of the dielectric resonator 20 is.

It should be noted that the number of adjusting screws arranged on the cover may be adjusted according to the actual requirement. For example, when only the bandwidth of the dielectric resonator 20 needs to be increased and the hole size of the first adjusting hole 22 is greater than the hole size of the second adjusting hole 23, only the second adjusting screw may be arranged in the position that is on the cover and corresponds to the second adjusting hole 23. By means of adjustment of the second adjusting screw to insert the second adjusting screw into the second adjusting hole 23, the bandwidth of the dielectric resonator 20 may be increased.

In the present application, a top of the first adjusting hole 22 and a top of the second adjusting hole 23 are on a same plane. Adjusting screws may be arranged in positions that are on the cover and correspond to the top of the first adjusting hole 22 and the top of the second adjusting hole 23, so as to adjust the frequency and the bandwidth of the dielectric filter loft The adjusting screws are on a same plane, so that adjustment of the frequency and the bandwidth of the dielectric filter 100 on the same plane is implemented, which is different from the prior art in which the frequency and the bandwidth of the dielectric filter need to be adjusted around the dielectric filter, and does not interfere with component assembling around the dielectric filter; therefore it is convenient for a user to perform adjustment and assembling. In addition, because the first adjusting hole 22 and the second adjusting hole 23 are not mirror symmetric relative to the first mirror plane 213 and the second mirror plane 214, a dielectric structure of the dielectric body 21 of the dielectric resonator 20 is changed. Theoretically, according to principles of the electromagnetic field, a change of the dielectric structure of the dielectric body 21 of the dielectric resonator 20 may lead to a change in the distribution of the electromagnetic field inside the dielectric resonator 20 and the dielectric filter 100. According to simulation results, the change in the distribution of the electromagnetic field inside the dielectric resonator 20 may change the frequency and the bandwidth of the dielectric resonator 20, that is, the frequency and the bandwidth of the dielectric filter 100 may be adjusted; therefore, a purpose of changing the frequency and the bandwidth of the dielectric filter 100 may be achieved.

In this implementation manner, the bandwidth of the dielectric resonator 20 is in direct proportion to a hole size difference of the first adjusting hole and the second adjusting hole. A difference of the two working frequencies of the dielectric resonator 20 is the bandwidth of the dielectric filter loft Certainly, if the number or hole sizes of adjusting holes disposed on the dielectric resonator 20 changes, the dielectric structure of the dielectric body 21 of the dielectric resonator 20 may change, which leads to a change in the distribution of the electromagnetic field inside the dielectric resonator 20 and the dielectric filter 100. The change in the distribution of the electromagnetic field inside the dielectric resonator 20 causes the frequency and the bandwidth of the dielectric resonator 20 to change. That is, the frequency and the bandwidth of the dielectric filter 100 also change. Therefore, a corresponding number of adjusting holes or adjusting holes of a corresponding hole size may be disposed on the dielectric resonator 20 according to an actual requirement, which extends the adjustment ranges of the frequency and the bandwidth of the dielectric filter 100, and enables the dielectric filter 100 to apply to different application scenarios.

Figure 4:
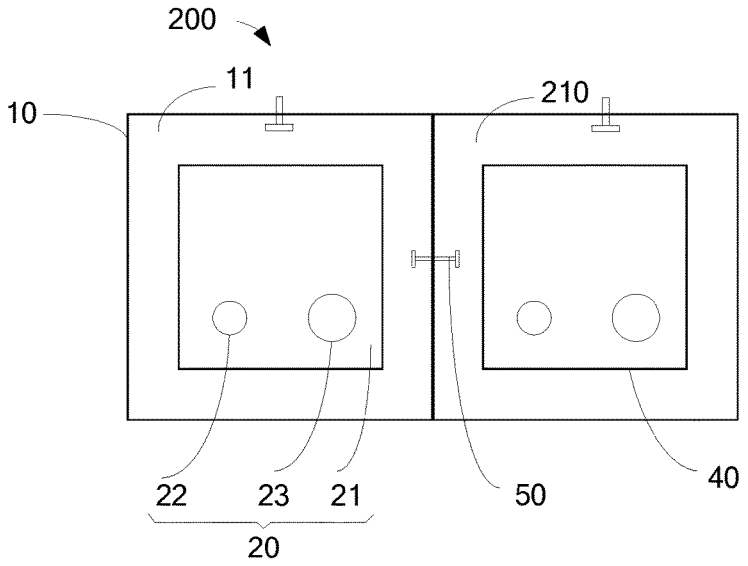
FIG. 4 is a schematic top view of a dielectric filter according to a second exemplary implementation manner of the present application.
Figure 5:
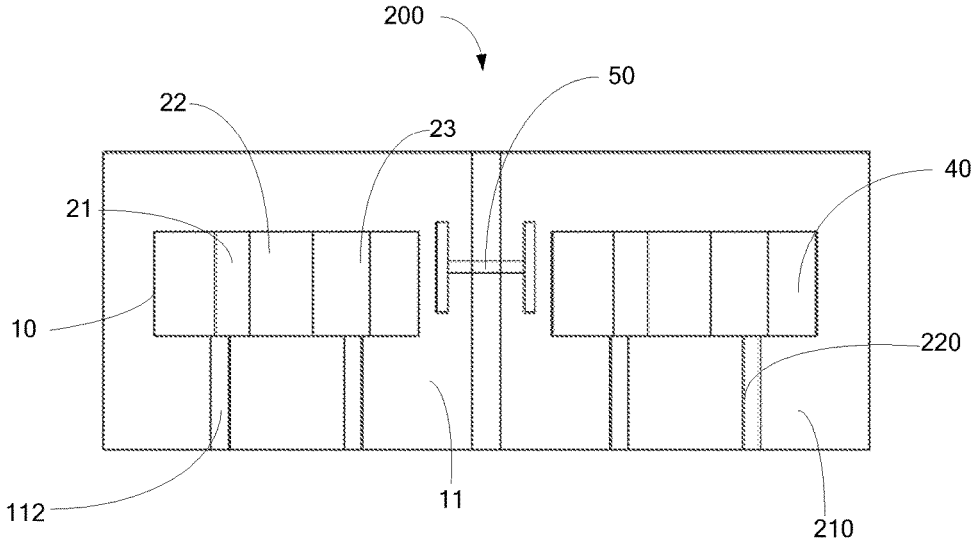
FIG. 5 is a side view of the dielectric filter in FIG. 4.
Figure 6:
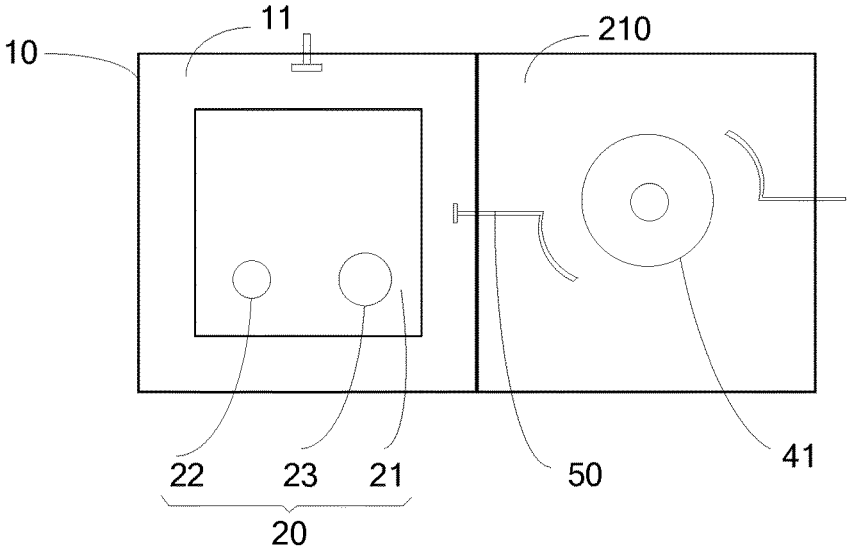
FIG. 6 is a schematic top view of a dielectric filter according to a third exemplary implementation manner of the present application.
Figure 7:
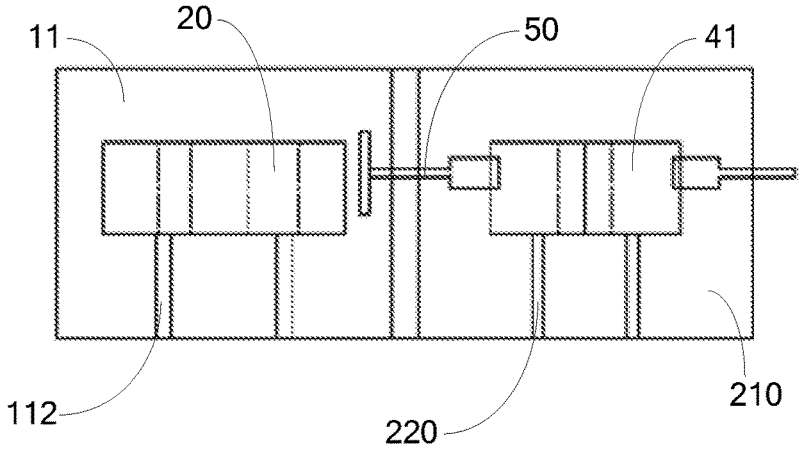
FIG. 7 is a side view of the dielectric filter in FIG. 6.
Figure 8:
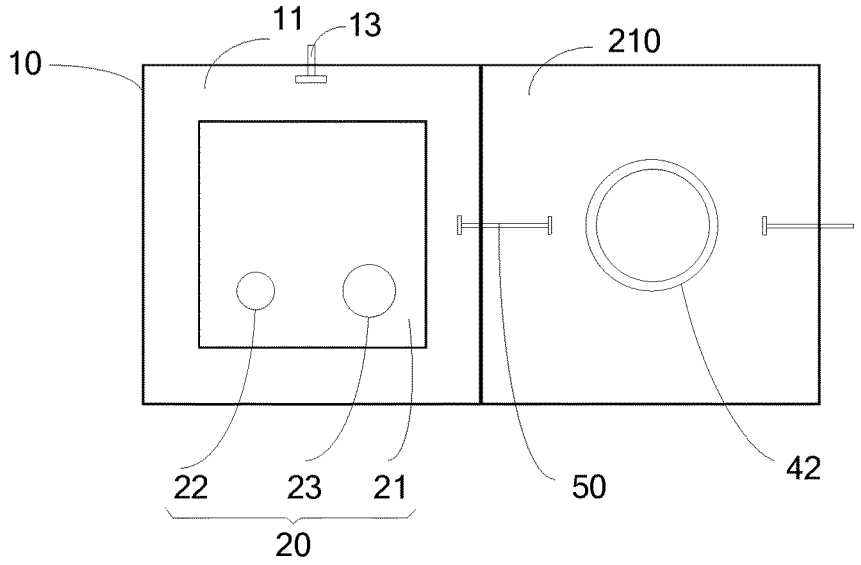
FIG. 8 is a schematic top view of a dielectric filter according to a fourth exemplary implementation manner of the present application.
Figure 9:
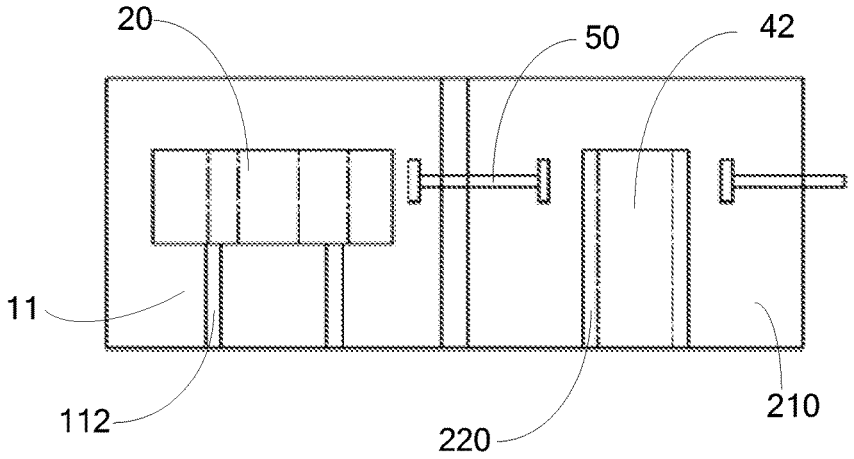
FIG. 9 is a side view of the dielectric filter in FIG. 8.

Reference is made to FIG. 4 and FIG. 5, and a second exemplary implementation manner of the present application provides a dielectric filter 200. The dielectric filter 200 provided in the second exemplary implementation manner is similar to the dielectric filter 100 provided in the first exemplary implementation manner. A difference between the two dielectric filters lies in that: in the second exemplary implementation manner, the dielectric filter 200 may further include a second dielectric resonator 40. A second cavity 210 is further formed in the dielectric filter 200. A second support kit 220 is disposed at a bottom of the second cavity 210. The second dielectric resonator 40 is contained in the second cavity 210 and is disposed on the second support kit 220. The second dielectric resonator 40 is connected to the first dielectric resonator 20 by using a coupled mechanical part 50. The coupled mechanical part 50 is used to couple energy from the first dielectric resonator 20 to the second dielectric resonator 40 or from the second dielectric resonator 40 to the first dielectric resonator 20.

In this implementation manner, the coupled mechanical part 50 may be a metal plate. The second dielectric resonator 40 may be a dual-mode dielectric resonator. A structure and a function of the second dielectric resonator 40 are the same as a structure and a function of the first dielectric resonator 20, and details are not described herein again.

Reference is made to FIG. 6 to FIG. 9, and a third exemplary implementation manner and a fourth exemplary implementation manner of the present application separately provide a dielectric filter. The dielectric filters provided in the third exemplary implementation manner and in the fourth exemplary implementation manner are similar to the dielectric filter provided in the second exemplary implementation manner. A difference lies in that: in the third exemplary implementation manner, the second dielectric resonator is a dielectric resonator 41 in a $TE_{01\delta}$ mode; in the fourth exemplary implementation manner, the second dielectric resonator is a coaxial resonator (metal or dielectric) 42. Because the dielectric resonator 41 in the $TE_{01\delta}$ mode or the coaxial resonator 42 exists in the prior art, their structures are not described in this embodiment of the present application. The structures of the dielectric resonator 41 in the $TE_{01\delta}$ mode and the coaxial resonator 42 are different from a structure of the first dielectric resonator 20.

In other implementation manners, the second dielectric resonator may further be adjusted to a dielectric resonator of another type according to a requirement.

Figure 10:
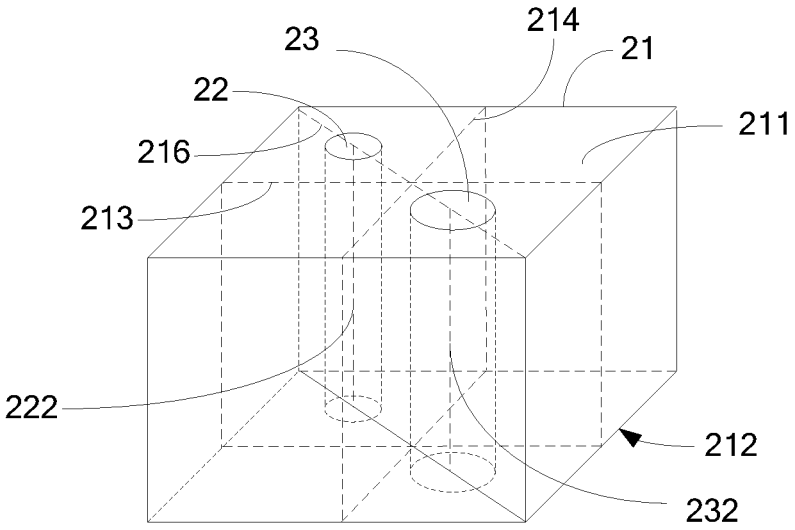
FIG. 10 is a schematic diagram of a second exemplary embodiment of the dielectric resonator in FIG. 1.

Reference is made to FIG. 10, and an embodiment of the present application further provides a second exemplary implementation manner of a dielectric resonator 20. In the provided second exemplary implementation manner of the dielectric resonator, both an axis 222 of the first adjusting hole 22 and an axis 232 of the second adjusting hole 23 are on a second diagonal plane 216, and the axis 222 of the first adjusting hole 22 may be parallel with the axis 232 of the second adjusting hole 23.

In this implementation manner, a hole size of the first adjusting hole 22 is different from a hole size of the second adjusting hole 23. Optionally, the hole size of the first adjusting hole 22 and the hole size of the second adjusting hole 23 may also be the same.

Figure 11:
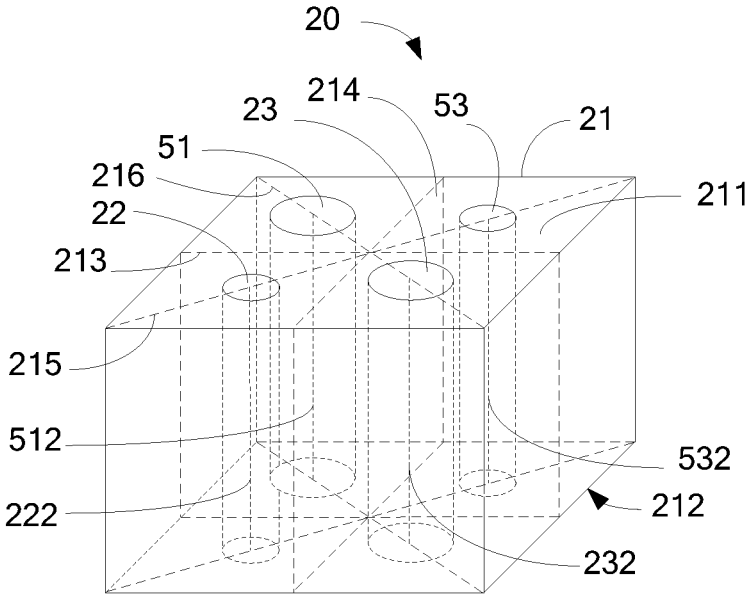
FIG. 11 is a schematic diagram of a third exemplary embodiment of the dielectric resonator in FIG. 1.

Reference is made to FIG. 11, and an embodiment of the present application further provides a third exemplary implementation manner of a dielectric resonator 20. In the third exemplary implementation manner, the at least two adjusting holes further include a third adjusting hole 51. An axis 512 of the third adjusting hole 51 is on a second diagonal plane 216 and is parallel with an axis 232 of a second adjusting hole 23.

Specifically, in this embodiment, the third adjusting hole 51 may be in a cylindrical shape. The third adjusting hole 51 may be perpendicular to and penetrate through a top plane 211 and a bottom plane 212 of a dielectric body 21.

Since any two of the first adjusting hole 22, the second adjusting hole 23 and the third adjusting hole 51 are not mirror symmetric relative to a first mirror plane 213 or a second mirror plane 214, a dielectric structure of the dielectric body 21 of the dielectric resonator 20 is changed, therefore leading to a change in distribution of an electromagnetic field inside the dielectric resonator 20. According to simulation results, the change in the distribution of the electromagnetic field inside the dielectric resonator 20 may change a frequency and bandwidth of the dielectric resonator 20, that is, adjust a frequency and bandwidth of a dielectric filter.

Further, the dielectric resonator 20 may further include a fourth adjusting hole 53. An axis 532 of the fourth adjusting hole 53 is on the first diagonal plane 215 and may be parallel with an axis 222 of the first adjusting hole 22.

Specifically, the fourth adjusting hole 53 may be in a cylindrical shape. The fourth adjusting hole 53 may be perpendicular to and penetrate through the top plane 211 and the bottom plane 212 of the dielectric body 21. A hole size of the first adjusting hole 22 is the same as a hole size of the fourth adjusting hole 53. A hole size of the second adjusting hole 23 is the same as a hole size of the third adjusting hole 51. The hole size of the first adjusting hole 22 is different from the hole size of the second adjusting hole 23.

Since any two of the first adjusting hole 22, the second adjusting hole 23, the third adjusting hole 51 and the fourth adjusting hole 53 are not mirror symmetric relative to the first mirror plane 213 or the second mirror plane 214, the dielectric structure of the dielectric body 21 of the dielectric resonator 20 is changed, therefore leading to a change in the distribution of the electromagnetic field inside the dielectric resonator 20. According to the simulation results, the change in the distribution of the electromagnetic field inside the dielectric resonator 20 may change the frequency and the bandwidth of the dielectric resonator 20, that is, adjust the frequency and the bandwidth of the dielectric filter.

Figure 12:
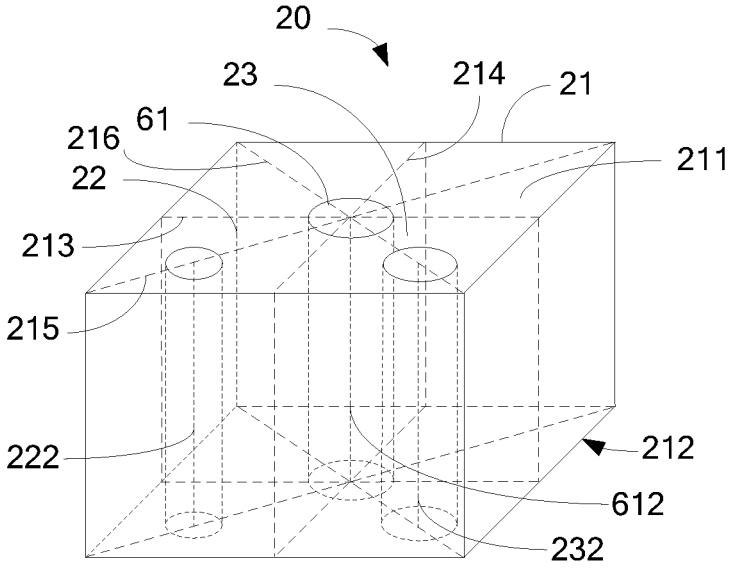
FIG. 12 is a schematic diagram of a fourth exemplary embodiment of the dielectric resonator in FIG. 1.

Reference is made to FIG. 12, and an embodiment of the present application further provides a fourth exemplary implementation manner of a dielectric resonator 20. In the fourth exemplary implementation manner, the dielectric resonator 20 further includes a fifth adjusting hole 61. An axis of the fifth adjusting hole is an intersection line of the first diagonal plane 215 and the second diagonal plane 216.

In this implementation manner, the fifth adjusting hole 61 may be in a cylindrical shape. A hole size of the fifth adjusting hole 61 is different from hole sizes of the first adjusting hole 22 and the second adjusting hole 23.

Since any two of the first adjusting hole 22, the second adjusting hole 23, and the fifth adjusting hole 61 are not mirror symmetric relative to a first mirror plane 213 or a second mirror plane 214, and therefore changing a dielectric structure of a dielectric body 21 of the dielectric resonator 20 leads to a change in distribution of an electromagnetic field inside the dielectric resonator 20. According to simulation results, the change in the distribution of the electromagnetic field inside the dielectric resonator 20 may change a frequency and bandwidth of the dielectric resonator 20, that is, adjust a frequency and bandwidth of a dielectric filter.

Figure 13:
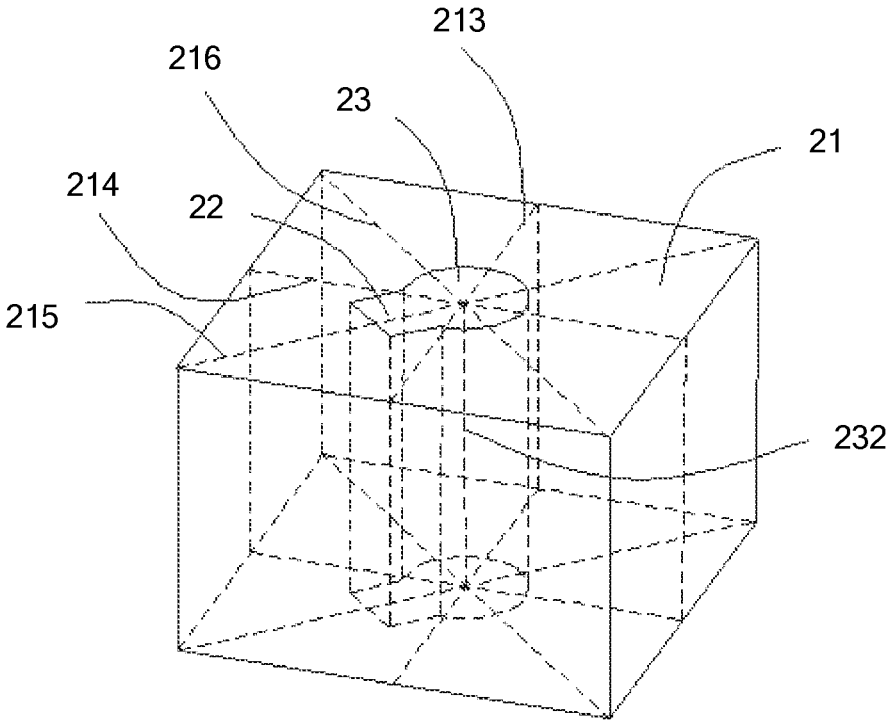
FIG. 13 is a schematic diagram of a fifth exemplary embodiment of the dielectric resonator in FIG. 1.

Reference is made to FIG. 13, and an embodiment of the present application further provides a fifth exemplary implementation manner of a dielectric resonator 20. In the provided fifth exemplary implementation manner of the dielectric resonator, an axis of the second adjusting hole 23 is an intersection line of the first diagonal plane 215 and the second diagonal plane 216.

Specifically, in this implementation manner, the second adjusting hole 23 may be connected to the first adjusting hole 22. The first adjusting hole 22 may specifically be in a quadrangular prismatic shape. The second adjusting hole 23 may specifically be in a cylindrical shape.

It should be understood that, the shape of the first adjusting hole 22 and the shape of the second adjusting hole 23 may be adjusted according to an actual requirement. The first adjusting hole 22 and the second adjusting hole 23 may be not connected according to an actual requirement. In addition, because a frequency and bandwidth of the dielectric filter relate to the number and hole sizes of adjusting holes disposed on the dielectric body 21, the number and hole sizes of adjusting holes disposed on the dielectric body 21 may be adjusted according to an actual requirement for the frequency and bandwidth of the dielectric filter.

In the foregoing implementation manner, when the dielectric body 21 is a cylinder, the first diagonal plane 215 and the second diagonal plane 216 are perpendicular to each other. Sector planes of two adjacent included angles formed between the first diagonal plane 215 and the second diagonal plane 216 are planes on which axes (that is, a central line) of a first port and a second port of the dielectric filter are separately located.

In the foregoing implementation manner, a top of the first adjusting hole 22 and a top of the second adjusting hole 23 are on a same plane. Adjusting screws may be arranged in positions that are on the cover and correspond to the top of the first adjusting hole 22 and the top of the second adjusting hole 23, so as to adjust a frequency and bandwidth of a dielectric filter loft The adjusting screws are on a same plane, so that adjustment of the frequency and the bandwidth of the dielectric filter 100 on the same plane is implemented, which is different from the prior art in which the frequency and the bandwidth of the dielectric filter need to be adjusted around the dielectric filter, and does not interfere with component assembling around the dielectric filter; and therefore it is convenient for a user to perform adjustment and assembling. In addition, because the first adjusting hole 22 and the second adjusting hole 23 are not mirror symmetric relative to a first mirror plane 213 or a second mirror plane 214, a dielectric structure of the dielectric body 21 of the dielectric resonator 20 is changed. Theoretically, according to principles of an electromagnetic field, a change of the dielectric structure of the dielectric resonator 20 may lead to a change in distribution of the electromagnetic field inside the dielectric resonator 20. According to simulation results, the change in the distribution of the electromagnetic field inside the dielectric resonator 20 changes a frequency and bandwidth of the dielectric resonator 20, that is, the frequency and the bandwidth of the dielectric filter 100 are adjusted. In addition, according to the simulation results, disposing multiple adjusting holes on the dielectric body 21 increases an interval of frequencies between a main mode (that is, working mode) and a high order mode of a dual-mode dielectric resonator, and therefore a suppression feature of the dual-mode dielectric resonator is improved.

Certainly, if the number or hole sizes of adjusting holes disposed on the dielectric resonator 20 change, the dielectric structure of the dielectric body 21 of the dielectric resonator 20 may change, which leads to a change in the distribution of the electromagnetic field inside the dielectric resonator 20 and the dielectric filter 100. The change in the distribution of the electromagnetic field inside the dielectric resonator 20 causes the frequency and the bandwidth of the dielectric resonator 20 to change. That is, the frequency and the bandwidth of the dielectric filter 100 also change. Therefore, a corresponding number of adjusting holes or adjusting holes of a corresponding hole size may be disposed on the dielectric resonator 20 according to an actual requirement, which extends the adjustment ranges of the frequency and the bandwidth of the dielectric filter 100, and enables the dielectric filter 100 to apply to different application scenarios.

Finally, it should be noted that the foregoing embodiments are merely intended for describing the technical solutions of the present application rather than limiting the present application. Although the present application is described in detail with reference to the foregoing embodiments, a person of ordinary skill in the art should understand that the protection scope of the present application is not limited thereto, and any variation or replacement readily figured out by a person skilled in the art within the technical scope disclosed in the present application shall fall within the protection scope of the present application. Therefore, the protection scope of the present application shall be subject to the protection scope of the claims.

What is claimed is:

1. A dielectric resonator, disposed in a cavity of a dielectric filter, wherein the dielectric resonator is physically separate from an outer body of the dielectric filter, wherein the dielectric resonator is a dual-mode dielectric resonator and is configured to support a Hybrid Electromagnetic (HE) mode, and the dielectric resonator comprises a dielectric body;

wherein at least two holes are disposed on the dielectric body and the dielectric body comprises a top plane and a bottom plane;

wherein the at least two holes penetrate through the top plane and the bottom plane of the dielectric body;

wherein the dielectric body has a first mirror plane and a second mirror plane, and the second mirror plane and the first mirror plane are perpendicular to each other and both penetrate through the top plane and the bottom plane of the dielectric body; and wherein the at least two holes are not mirror symmetric relative to the first mirror plane and the second mirror plane.

2. The dielectric resonator according to claim 1, wherein the dielectric body has a first diagonal plane and a second diagonal plane, and axes of the at least two holes are separately on the first diagonal plane and the second diagonal plane or are both on one diagonal plane of the first diagonal plane and the second diagonal plane.

3. The dielectric resonator according to claim 2, wherein the dielectric body is a cylinder, the first diagonal plane and the second diagonal plane are perpendicular to each other, and sector planes of two adjacent included angles formed between the first diagonal plane and the second diagonal plane are planes on which axes of a first port and a second port of the dielectric filter are separately located.

4. The dielectric resonator according to claim 2, wherein the first mirror plane is a plane on which an axis of a first port of the dielectric filter is located, and the second mirror plane is a plane on which an axis of a second port of the dielectric filter is located.

5. The dielectric resonator according to claim 2, wherein the at least two holes comprise a first hole and a second hole, and an axis of the first hole is on the first diagonal plane, an axis of the second hole is on the second diagonal plane, or the axes of the first hole and the second hole are both on the second diagonal plane.

6. The dielectric resonator according to claim 5, wherein the at least two holes further comprise a third hole, and an axis of the third hole is on the second diagonal plane and is parallel with the axis of the second hole.

7. The dielectric resonator according to claim 6, wherein the at least two holes further comprise a fourth hole, and an axis of the fourth hole is on the first diagonal plane and is parallel with the axis of the first hole.

8. The dielectric resonator according to claim 7, wherein the first to the fourth holes are cylindrical holes, and a hole size of the first hole is the same as a hole size of the fourth hole, a hole size of the second hole is the same as a hole size of the third hole, and the hole size of the first hole is different from the hole size of the second hole.

9. The dielectric resonator according to claim 5, wherein the at least two holes further comprise a fifth hole, and an axis of the fifth hole is an intersection line of the first diagonal plane and the second diagonal plane.

10. The dielectric resonator according to claim 5, wherein the axis of the second hole is an intersection line of the first diagonal plane and the second diagonal plane.

11. The dielectric resonator according to claim 10, wherein the second hole is connected to the first hole.

12. A dielectric filter, comprising a body part, a cover, and a first dielectric resonator, wherein the first dielectric resonator is a dual-mode dielectric resonator and is configured to support a Hybrid Electromagnetic (HE) mode;

wherein the body part comprises a first port and a second port, and the first port and the second port are configured to input and output signals;

wherein a first cavity is further formed in the body part, and a first support kit is disposed at a bottom of the first cavity;

wherein the first dielectric resonator is disposed in the first cavity of the dielectric filter and is physically separate from an outer body of the dielectric filter;

wherein the first dielectric resonator comprises a dielectric body, wherein at least two holes are disposed on the dielectric body and the dielectric body comprises a top plane and a bottom plane, wherein the at least two holes penetrate through the top plane and the bottom plane of the dielectric body;

wherein the dielectric body has a first mirror plane and a second mirror plane, and the second mirror plane and the first mirror plane are perpendicular to each other and both penetrate through the top plane and the bottom plane of the dielectric body; and wherein the at least two holes are not mirror symmetric relative to the first mirror plane and the second mirror plane.

13. The dielectric filter according to claim 12, wherein an axis of the first port is on the first mirror plane, and an axis of the second port is on the second mirror plane.

14. The dielectric filter according to claim 12, wherein the dielectric body in the first dielectric resonator comprises a first diagonal plane and a second diagonal plane, and axes of the at least two holes are separately on the first diagonal plane and the second diagonal plane or are both on one diagonal plane of the first diagonal plane and the second diagonal plane.

15. The dielectric filter according to claim 14, wherein the at least two holes in the first dielectric resonator comprise a first hole and a second hole, and an axis of the first hole is on the first diagonal plane, an axis of the second hole is on the second diagonal plane, or the axes of the first hole and the second hole are both on the second diagonal plane.

16. The dielectric filter according to claim 15, wherein screws are arranged in positions that are on the cover and correspond to the first hole and the second hole, for adjusting at least one of a frequency and bandwidth of the dielectric filter.

17. The dielectric filter according to claim 15, wherein the at least two holes in the first dielectric resonator further comprise a third hole, and an axis of the third hole is on the second diagonal plane and is parallel with the axis of the second hole.

18. The dielectric filter according to claim 12, wherein the dielectric filter further comprises a second dielectric resonator and a coupled mechanical part;

wherein a second cavity is further formed in the dielectric filter, and a second support kit is disposed at a bottom of the second cavity;

wherein the second dielectric resonator is contained in the second cavity and is disposed on the second support kit; and wherein the second dielectric resonator is connected to the first dielectric resonator by using the coupled mechanical part.

19. A dielectric filter, comprising a body part, a cover and a dielectric resonator, wherein the dielectric resonator is a dual-mode dielectric resonator configured to support a Hybrid Electromagnetic (HE) mode;

wherein the body part comprises a first port and a second port, and the first port and the second port are configured to input and output signals;

wherein a first cavity is further formed in the body part, and a first support kit is disposed at a bottom of the first cavity;

wherein the dielectric resonator is disposed in the first cavity of the dielectric filter and is physically separate from an outer body of the dielectric filter;

wherein the dielectric resonator comprises a dielectric body, wherein the dielectric body has at least two holes and the dielectric body comprises a top plane and a bottom plane, wherein the at least two holes penetrate through the top plane and the bottom plane of the dielectric body; and wherein screws are arranged on the cover, and the screws are configured to adjust at least one of a frequency and bandwidth of the dielectric filter.

20. The dielectric filter according to claim 19, wherein the screws are arranged in positions that are on the cover and correspond to the at least two holes.

* * * * *